US009026030B2

(12) United States Patent
Vetromile et al.

(10) Patent No.: US 9,026,030 B2
(45) Date of Patent: May 5, 2015

(54) MULTI-JOB FEEDER SYSTEM

(75) Inventors: Joseph S Vetromile, Rochester, NY (US); Kenneth P Moore, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 2100 days.

(21) Appl. No.: 12/132,661

(22) Filed: Jun. 4, 2008

(65) Prior Publication Data

US 2009/0304430 A1 Dec. 10, 2009

(51) Int. Cl.
*G03G 15/00* (2006.01)

(52) U.S. Cl.
CPC .... *G03G 15/655* (2013.01); *G03G 2215/00894* (2013.01)

(58) Field of Classification Search
USPC ..... 399/382; 271/3.14, 9.07, 9.05, 9.08, 271/162, 265.01
See application file for complete search history.

(56) References Cited

U.S. PATENT DOCUMENTS 4,757,348 A * 7/1988 Rourke et al. ..... 399/84
5,227,816 A * 7/1993 Forest ..... 347/153
5,488,458 A 1/1996 Benedict et al.
6,457,651 B2 10/2002 Paul et al.
6,985,682 B2 * 1/2006 Haines et al. ..... 399/84
7,102,798 B2 * 9/2006 Haines et al. ..... 358/471
2005/0249535 A1 * 11/2005 Johnson ..... 399/389

OTHER PUBLICATIONS

U.S. Appl. No. 12/034,197, filed Feb. 20, 2008 and entitled Mulit-Job Feeder Apparatus and Method by Joseph S. Vetromile and Kenneth P. Moore.

* cited by examiner

*Primary Examiner* — Matthew G Marini

(57) ABSTRACT

A low cost, low complexity method and apparatus for improved productivity and reducing operator induced shut-downs when feeding multiple jobs of different media type, but the same size, from a single sheet tray includes providing media identification divider sheets that contain patterns of either simple bars or punched holes with the divider sheets loaded into the sheet supply tray on top of their corresponding sheet stack except the first one; providing a digital sensor that reads each media identification divider sheet pattern; and feeding media for the first job. When the first job is complete, remaining sheets for that job can be fed (optionally at high speed) to a purge tray. Media divider sheets for each successive job after the first job are sent to the purge tray for reuse later.

20 Claims, 4 Drawing Sheets

MULTI-JOB FEEDER SYSTEM

Cross referenced and commonly assigned U.S. application Ser. No. 12/034,197, filed Feb. 20, 2008 and entitled MULTI-JOB FEEDER APPARATUS AND METHOD by Joseph S. Vetromile and Kenneth P. Moore, now Publication No. 20090206153, and is included in its' entirety herein by reference.

This invention relates in general to an image forming apparatus, and more particularly, to an image forming apparatus employing a multi-job feeder tray.

Conventionally, a feeder module in a high-speed imaging apparatus includes two or more sheet capacity media supplies. One paper type in a tray at a time is intended to be loaded, therefore, requiring unloading and reloading with changing paper requirements as the job necessitates. This causes significant delays between jobs, especially for short job lengths. To minimize delay time, operators have been stacking multiple job stacks of different paper types on top of each other separated by a job divider of various types. This requires trays to be opened to have residual paper and dividers removed after each job, which reduces productivity. In some cases, paper is used up before job completion causing an operator induced shut down (misfeed) when there is an attempt to feed thick dividers.

U.S. Pat. No. 5,488,458 discloses a duplex printing integrity system for insuring that correctly matching pages are being printed by a duplex printer on the opposing first and second sides of sheets. The printer is operable to selectively print marks along the sheets and optical sensors on opposite sides of the sheets are used to detect the marks and send signals to a comparison circuit that continuously compares the sensor output signals to provide a duplex printing error signal when the sensors provide different output signals. In U.S. Pat. No. 6,457,651 B2 a dual level encryption method, and document, is provided for obtaining a substantially increased amount of optically readable information from an otherwise conventional and highly visible printed bar-code pattern area on a document without interfering with the conventional optical reading of the conventional information in the bar-code.

While disclosures of the above-mentioned patents are useful, they do not answer the operator intervention problem presented when feeding multiple types of paper and printing jobs from a paper feed tray.

Accordingly, a system is disclosed for stacking different types of same-sized sheets for multiple jobs in a paper feed tray and allowing job streaming without operator intervention and thereby improving productivity and reducing operator induced shut-downs that includes: manually programming each print job into the printer's controller to be run corresponding with the order of media loaded in the paper feed tray; providing a unique, printed or punched pattern on low cost, job divider sheets; loading the divider sheets into the sheet supply with their corresponding sheet stack; and providing a conventional digital sensor at the sheet supply that reads each divider sheet printed or punched pattern through holes in the divider sheets as they exit the paper feed tray. No divider sheet is needed for the first job. Once the first divider sheet is sensed (second job), it is then fed to a predetermined output tray before the job starts. When the job is complete, remaining paper for that job is fed (optionally, at high speed) to the predetermined output tray with the corresponding divider sheet for reuse later. If too few sheets were loaded for the job, the feeder will cause a soft cycle down when it sees the pattern on the next job divider sheet and flag the problem. Alternatively, an option could be included, such that, if a job is running and the next divider sheet pattern is seen before the job is completed (i.e., a misfeed and soft shut down occurs), the system will flag the operator on the user interface (not shown), and use the next patterned divider sheet to continue running the jobs.

The disclosed reprographic system that incorporates the disclosed improved system for stream feeding sheets for multiple jobs from a feed tray may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet of paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
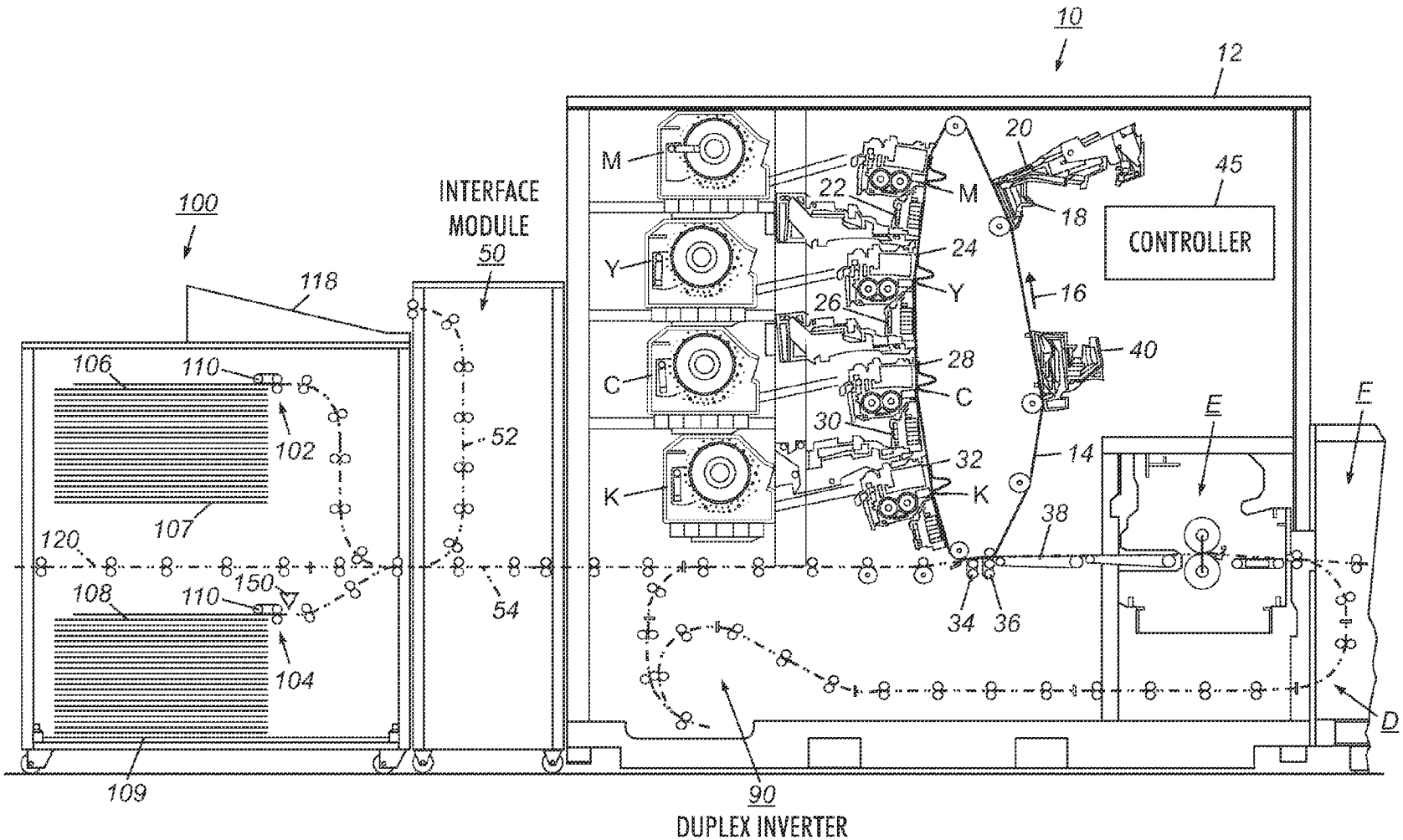
FIG. 1 is a partial, frontal view of an exemplary modular xerographic printer that includes the improved job streaming system of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method of loading multiple types of same sized paper in a feed tray to allow printing of multiple jobs without operator intervention.

For a general understanding of the features of the disclosure, reference is made to the drawings. In the drawings, like reference numerals have been used throughout to identify identical elements.

Referring now to printer 10 in FIG. 1 that, as in other xerographic machines, and as is well known, shows an electrographic printing system including the improved system and apparatus for feeding multiple types of same sized paper and printing jobs from a paper feed tray embodiment of the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, etc., which performs a print outputting function for any purpose. Marking module 12 includes a photoreceptor belt 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives copy sheets from sheet feeder module 100 through interface module 50 and brings the copy sheets into contact with the image on belt 14. Sheet feeder module 100 includes high capacity feeders 102 and 104 that feed sheets from sheet stacks 106 and 108 positioned on media supply trays 107 and 109 into interface module 50 that directs them either to purge tray 118 through sheet feed path 52 or to imaging or marking module 12 through sheet feed path 54. Additional high capacity media trays could be added to feed sheets along sheet path 120, if desired.

A corotron 34 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then advances to stacker module F, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

Figure 2:
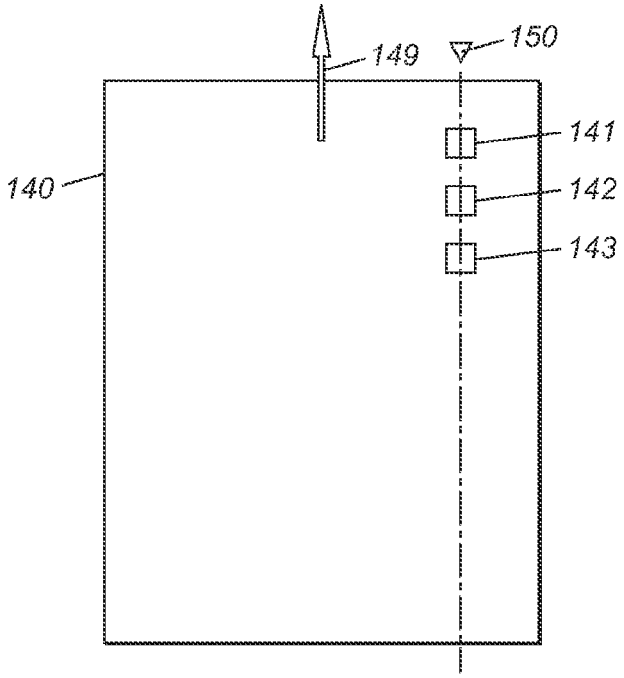
FIG. 2 is a plan view of media identification divider sheet.
Figure 3:
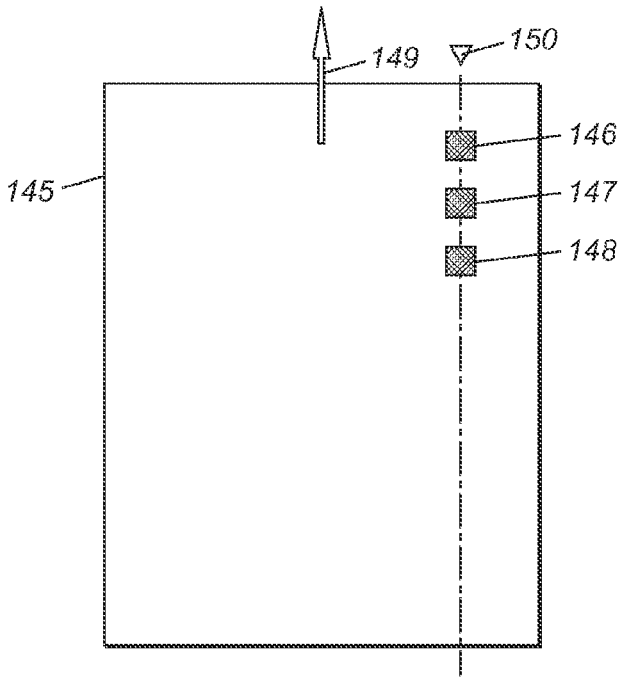
FIG. 3 is a plan view of an alternative media identification divider sheet.
Figure 4:
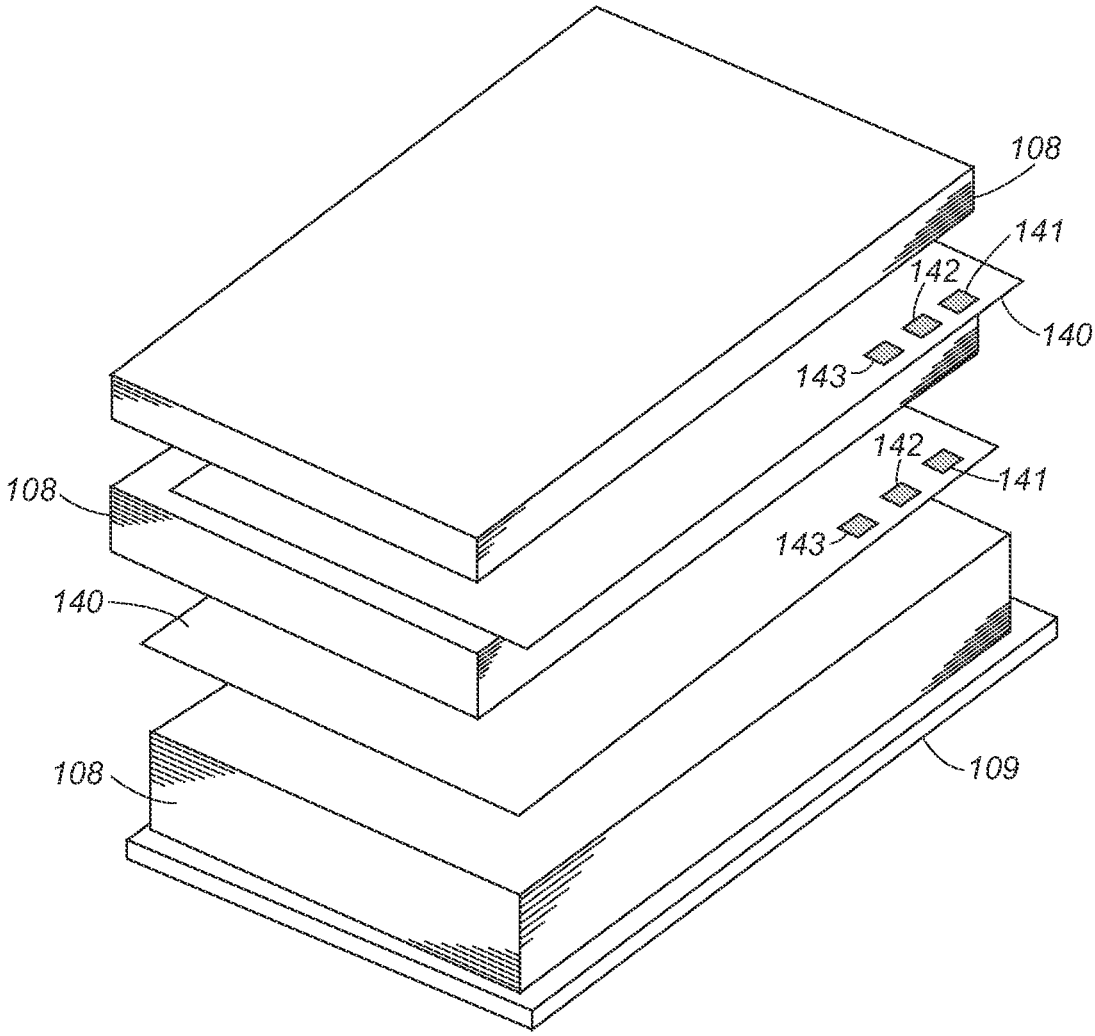
FIG. 4 is a perspective view showing stacks of copy sheets with the copy sheet stacks being separated into individual jobs by cover sheets.
Figure 5:
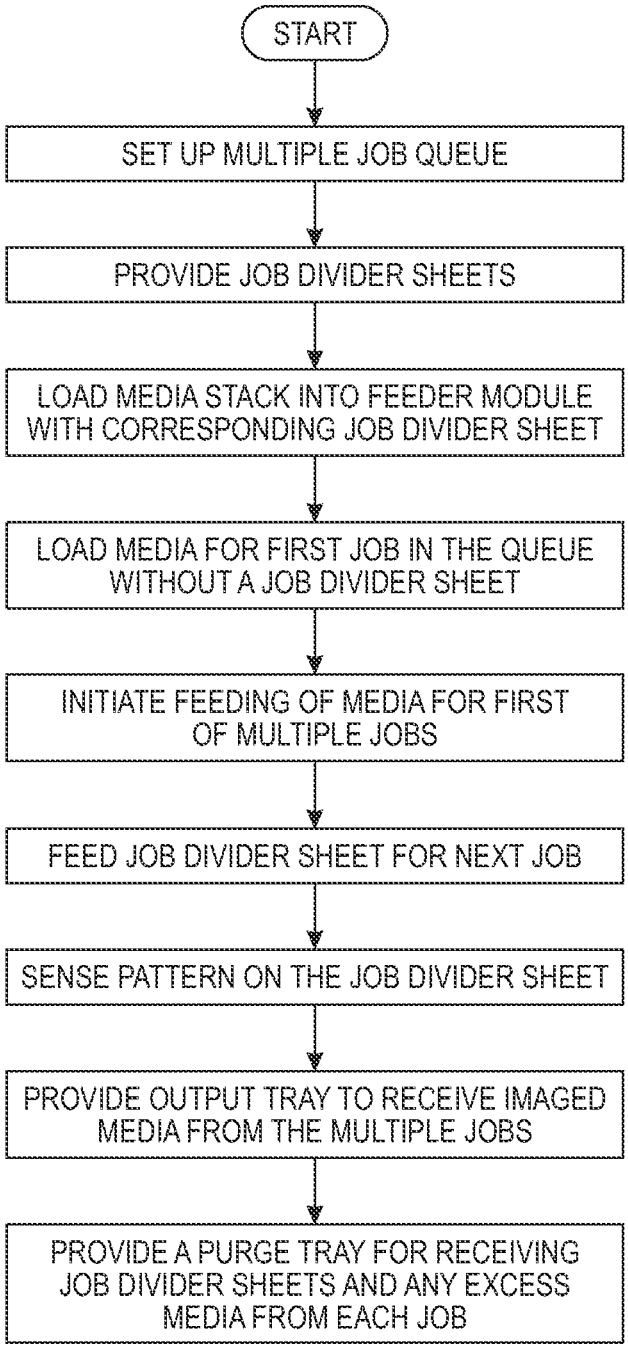
FIG. 5 is a flow chart showing overall job flow.

With further reference to the FIGS. 1-5, and in accordance with the present disclosure, low cost media identification divider sheets 140 and 145 in FIGS. 2 and 3, respectively, and a conventional, low cost, digital sensor 150 through controller 45 facilitate a cost, productivity and convenience improvement for operators that feed many small jobs on various sheet types of the same sheet size by allowing the printing of multiple jobs without operator intervention as depicted in the flow chart in FIG. 5. In practice, a unique, simple pattern of punched holes 141, 142 and 143 in FIG. 2 or printed bars 146, 147 and 148 in FIG. 3 are created on a media identification divider sheet with the pattern aligning as shown in dotted lines in FIGS. 2 and 3 to standard digital sensor 150 positioned to read the pattern as it passes in the direction of arrow 149 by the sensor at the exit of feeder 104 of media tray 109. Media tray 107 could be equipped to feed multiple jobs, if desired. It should be understood that media identification divider sheets 140 and 145 are examples only and other configurations are usable as well as long as they are readable by sensor 150 including a combination of holes and patterns. Sensor 150, alternatively, could be mounted on/in the feed head or on any location which would give more time for the sensor to read the media identification divider sheet before the start of the next feed. Also, the media identification divider sheet could be prepared by hand, if desired. The cover sheet or media identification divider sheet is the same size paper as the jobs that it will be used to separate. When paper is loaded in the tray, the jobs are stacked in order with a divider sheet separating the stacks of paper for each job. The operator would be instructed to always load more than enough paper for each job. No divider sheet is needed on top of the first job. The first job is run. When the first job is completed, any remaining un-used paper in the sub-stack would feed out into the purge tray 118 on top of feeder module 100. This continues until the divider sheet for the next sub-stack is seen. Then this divider sheet is also diverted to the purge tray indicating the next sub-stack of paper has been reached. If too few sheets of paper were loaded for the job, the divider sheet on top of the next sub-stack to be fed would be seen too soon. The feeder would divert that divider sheet into the purge tray, stop feeding, and alert the operator, thus avoiding using the wrong media for the next job. Optionally, the remaining jobs could be run to completion, if desired. Unused paper could be fed to purge tray 118 at a higher pages per minute rate than normal if the feeder and paper path are enabled for higher speed. This would further improve productivity by reducing delay time between jobs.

Alternatively, while a method and apparatus has been disclosed embedded within a printer for stacking different types of same-sized sheets for multiple jobs in a paper supply and allowing job streaming without operator intervention, it should be understood that this capability could be offered as an option. Also, it should be understood that any or all feeders could utilize the same purge tray 118 through media paths 120 and 52.

In recapitulation, a system for loading multiple types of same size paper in a feed tray to allow printing of multiple jobs without operator intervention is enabled by providing low cost, job divider sheets for multiple jobs that include holes or simple printed bars. The job divider sheets are loaded into the paper supply tray on top of appropriate sized sheets for each job. A conventional digital sensor is used for sensing the divider information. The operator is always instructed to include more paper than is required for each job. The first job does not need a divider sheet and the job is started. When the job is completed the remaining paper is fed to the specified output tray for later use. If there are too few sheets for the job, the divider sheet for the next job is detected and the job will stop and the system will declare a problem, and optionally, could alert the operator of the problem, for example, through a user interface, and continue feeding the remaining jobs. The operator could finish the first job at a later time. Alternatively, if paper is remaining after the first job is finished, the unused paper could be fed to the specified tray at a higher page per minute rate than normal if the feeder and paper path are enabled for higher speed. Thus, improving productivity by reducing delay time between jobs.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for improving productivity when feeding multiple types of media representing multiple print jobs with each print job including multiple pages from a selected media supply for processing within an image forming apparatus without operator intervention, including:

providing a multiple job queue;

providing media job divider sheets with a common pattern thereon to separate each of said multiple print jobs;

loading stacks of different types of same-sized media for each job into said media supply with corresponding media job divider sheets separating each job, and wherein said media job divider sheets are the only media within said stacks of media with a common pattern thereon;

providing a digital sensor adapted to sense the pattern on said media job divider sheets and transmit a signal representing the sensed pattern to a controller;

providing media for the first job in the queue without a media job divider sheet;

providing a feed head and initiating feeding for the first job of said multiple jobs;

providing a purge tray; and feeding any un-used media from the first job into said purge tray.

2. The method of claim 1, including causing a soft shut down if too few sheets of media is provided for the first job.

3. The method of claim 2, wherein said selected media supply is a high capacity media supply.

4. The method of claim 2, including providing a marking module for printing images onto media fed from said media tray, and wherein said purge tray is positioned upstream of said marking module.

5. The method of claim 4, including feeding un-used media for each particular job into said purge tray after a job is completed.

6. The method of claim 5, including feeding said un-used media to said purge tray at an increased speed.

7. The method of claim 6, including stopping feeding of a job when a media job divider sheet is sensed for a different job.

8. The method of claim 5, including providing a plurality of media trays with said purge tray positioned above said plurality of media trays.

9. The method of claim 8, including providing a media path that connects said purge tray with said plurality of media trays and a media path that connects said plurality of media trays to said marking module.

10. The method of claim 1, including alerting an operator that too few sheets of media are below said sensed media job divider sheet and then running the next job and any remaining jobs.

11. A reprographic device includes a productivity improvement when feeding multiple types of media representing multiple jobs from a selected media supply for processing within said reprographic device without operator intervention, comprising:

a marking module for printing images onto media;

a feeder module including a selected media supply for feeding media from a stack to said marking module;

a media identification divider sheet, said media identification divider sheet including a pattern thereon and is placed on top of media for each job to be printed except the first job, and wherein said media identification divider sheet is the only media within said stack of media with a pattern thereon; and a digital sensor adapted to sense said pattern on said media identification divider sheet as it is fed from said selected media supply to thereby identify a new media interface in the stack.

12. The reprographic device of claim 11, including a soft shut down if too few sheets of media are available for the first job and any subsequent jobs in said selected media tray.

13. The reprographic device of claim 11, wherein said pattern on said media identification divider sheet is a series of bars.

14. The reprographic device of claim 11, wherein said pattern on said media identification divider sheet is a series of holes aligned for sensing by said digital sensor.

15. The reprographic device of claim 11, including providing a purge tray positioned upstream of said marking module of said reprographic device and feeding each media identification divider sheet to said purge tray.

16. The reprographic device of claim 15, including feeding un-used media for a particular job into said purge tray after a job is completed.

17. The reprographic device of claim 15, including feeding said un-used media to said purge tray at an increased speed.

18. The reprographic device of claim 16, including stopping feeding of a job when a media identification divider sheet is sensed for a different job.

19. The reprographic device of claim 11, including alerting an operator that too few sheets of media are below said sensed media identification divider sheet and then running the next job and any remaining jobs.

20. The reprographic device of claim 11, including providing a plurality of media trays with said purge tray positioned above said plurality of media trays.

* * * * *